United States Patent [19]

Schaaf

[11] 4,061,619

[45] Dec. 6, 1977

[54] COPOLYAMIDE DISPERSIONS AND METHODS OF MAKING AND USING SAME

[75] Inventor: Siegfried Schaaf, Chur, Switzerland

[73] Assignee: Inventa AG fur Forschung und Patentverwertung, Zurich, Switzerland

[21] Appl. No.: 577,866

[22] Filed: May 15, 1975

[30] Foreign Application Priority Data

May 21, 1974 Switzerland ..... 6968/74

[51] Int. Cl.[2] ..... C08L 77/06

[52] U.S. Cl. ..... 260/29.2 N; 428/290

[58] Field of Search ..... 260/29.2 N, 33.4 R, 260/78, 857 UN, 29.6 NR; 427/195; 252/49.5, 49.3

[56] References Cited

U.S. PATENT DOCUMENTS

| | | | |
|---|---|---|---|
| 2,405,965 | 8/1946 | Leekley | 260/29.2 |
| 2,742,440 | 4/1956 | Stott et al. | 260/29.2 |
| 3,410,832 | 11/1968 | Schaaf et al. | 260/78 |
| 3,536,647 | 10/1970 | Battista | 260/29.2 |
| 3,536,780 | 10/1970 | Schaaf et al. | 260/78 |
| 3,708,435 | 1/1973 | Starckman | 260/29.2 |
| 3,844,997 | 10/1974 | Guthrie et al. | 260/29.2 N |

*Primary Examiner*—Theodore E. Pertilla
*Attorney, Agent, or Firm*—Bierman & Bierman

[57] ABSTRACT

A composition for causing one layer of fabric or similar material to adhere to an adjacent layer comprising a copolyamide dispersion containing 0.2 to 5.0% by weight of a fatty alcohol based on the total dispersion. A method of preparation of such dispersions and of dot coating with them is also disclosed.

11 Claims, No Drawings

COPOLYAMIDE DISPERSIONS AND METHODS OF MAKING AND USING SAME

This application claims the priority of Swiss Application 6968/74 filed May 21, 1974.

The present invention is directed to a printable copolyamide dispersion and a process for the preparation thereof. Such dispersions are useful for dot coating of fabric or fabric-like materials to enable them to adhere to adjacent layers. In particular, interlinings for articles of clothing are coated in accordance with this invention to enable them to adhere to the outer fabrics; so-called "front fixing".

Known methods of powder coating with copolyamide dispersions are described in detail in the Swiss technical journal "Textilveredlung" 9 (1974), 1, pp. 14–25. According to this journal, these powder coating operations can be carried out basically by three methods; by the powder spreading or dusting method, by powder dot coating similar to the intaglio process, and by dot coating by the screen printing process. In comparison with the powder spreading method and the powder dot method performed by the intaglio printing process, the coating method performed in accordance with the last-mentioned screen printing process shows advantages for certain uses of dot coated interlining fabrics.

In the screen printing process, copolyamide powders with grain sizes of less than 0.1 mm, preferably less than 0.08 mm, are employed, preferably in the form of aqueous dispersions. The usual aqueous dispersions employed in the known screen printing process contain 20–60% by weight (based on the total dispersion) of copolyamide powder, 5–20% by weight (based on the copolyamide powder) of plasticizers conventionally employed for polyamide, dispersing agents, thixotropy producing agents, and lubricants.

As plasticizers, aromatic sulfonamides or p-hydroxybenzoic acid esters are typical. The dispersing agents may be emulsifiers containing polyolefin oxide groups. Thixotropy producing agents are conventionally such materials as ammonium salts of homo- or copolymeric acrylic and/or methacrylic acids. As lubricants, glycerine or fatty acids are commonly used. These dispersions are not, however, entirely satisfactory. Partial separation of the dispersion into its component parts sometimes occurs and this results in irregular dot coatings and partial obstructions of the screen during production.

In order to eliminate this disadvantage, it has already been proposed to add fatty acids to the dispersions as lubricants (German laid-open patent specification 2,007,971). The use of fatty acids, such as stearic acid or palmitic acid, nevertheless has the disadvantage that their incorporation in the dispersion is complicated. First a "suspending medium" (as it is called in the above-mentioned German specification) must be prepared in the presence of the thixotropy producing agent by the introduction of steam, causing the fatty acid to melt. Then the plastic powder — sometimes accompanied by the plasticizer — is introduced into the suspending medium with stirring. It is well known, however, that fatty acids are employed as chain regulators in the preparation of polyamides and produce a degradation of the molecular chain of the polyamide in polyamide melts by transamidation reactions, depending upon their concentration in the copolyamide and the conditions of temperature and time. Since this may also occur in copolyamide melt adhesives, the tendency towards lower resistance of the textile unit produced with these textile adhesives to dry cleaning and to the known phenomenon of penetration or forcing back of the copolyamide adhesive dots when the fabrics are pressed or ironed together increases with decreasing molecular weight.

Surprisingly, it has now been found that when fatty alcohols are employed as inert lubricants in these copolyamide powder dispersions, the foregoing disadvantages do not occur.

Accordingly, the present invention relates to a printable copolyamide dispersion as a composition especially useful for dot coating interlinings for articles of clothing, comprising copolyamide powders with a grain size of up to 0.1 mm, water, a thixotropy producing agent and, if necessary, a dispersing agent and/or plasticizer, which is characterized in that this dispersion also contains as the lubricant, 0.2 to 5.0% by weight (based on the weight of the total dispersion) of fatty alcohol in very finely divided form. Preferably, the lubricant is present in an amount of 1 to 3%. The usual thixotropy producing, dispersing and plasticizing agents are used; as, for example, those hereinbefore mentioned.

The copolyamide powders employed in the invention preferably consist of ternary or quaternary copolyamide prepared from the monomeric constituents for polyamide 6, polyamide 12, polyamide 6,6, polyamide 6,10, polyamide 6,9, polyamide 6, 12 and/or other monomers known to be useful for making polyamides which have melting temperatures of 80°–135° C and preferably 100°–130° C. Examples are described in U.S. Pat. Nos. 3,410,832 and 3,536,780 and Swiss Application 11129/73.

Stearyl alcohol or cetyl alcohol or mixtures of the two are preferably employed as the fatty alcohol.

The incorporation of the fatty alcohol in the dispersion is very simple. The fatty alcohol is merely stirred into the dispersion by conventional methods, preferably at high speed. Moreover, it is immaterial in what sequence the various ingredients are introduced. The dispersion produced by this means shows a homogeneous distribution of the fatty alcohol, so that very good printability by the paste-dot screen printing method is provided without difficulty. According to the invention, it is not necessary to first prepare a "suspending medium" as is required by the previously mentioned German laid-open patent specification 2,007,971, before introducing the polyamide powder.

The fatty alcohols demonstrate a number of surprising advantages when compared with the known fatty acids. When fatty acids, such as stearic or palmitic acid are employed, mixing is not possible in one operation. The melting points of these acids are above the softening points of conventional copolyamide powders. The softening temperatures of these copolyamides (determined on a Kofler bench) begin, depending on their composition, at 68° C (see "Textilveredlung", 9 (1974) 1, pp. 14–25). The softening temperatures are lowered still further by additions of plasticizers. The result is an agglomeration of the copolyamide powder as soon as the melting temperature of the fatty acid is reached, which makes commercial use of the dispersion impossible.

On the other hand, the present invention using fatty alcohols as lubricants has the advantage that they can be incorporated directly in the copolyamide dispersion in one stirring operation, together with all the other constituents of the dispersion; no "suspending medium" being necessary as an intermediate step. In fact, on the intensive mixing of all the constituents, heating occurs and causes the fatty alcohol to melt and it is dispersed homogeneously, but no copolyamide powder particles can stick together to form agglomerates within the normal mixing time.

To further illustrate the invention, the following examples are set forth.

The viscosity is measured throughout with the Haake viscosimeter at 4 r.p.m.

EXAMPLE 1

30 kg of GRIL-tex 1 P 1 (grain size less than 0.08 mm), 4 kg of LUTEXAL HD-70, 7 kg of LATECOLL D, 2 kg of stearyl alcohol, 1 kg of 25% ammonium hydroxide and 56 kg of water are mixed for 6 minutes at a speed of 2000 r.p.m. in a Henschel mixer having a capacity of 160 l. The result is a homogeneous dispersion which is stable for many days which has good printability and a viscosity of 28000 centipoises.

EXAMPLE 2

26 kg of GRIL-tex 2 P 1 and 2 kg of GRIL-tex 4 P 1 (both with grain sizes of less than 0.08 mm), 9.5 kg of LATECOLL AS (10% solution), 1.5 kg of cetyl alcohol, 7 kg of PLASTOMOLL BMB and 54 kg of water are mixed thoroughly as in Example 1 in a Henschel mixer with a capacity of 160 l. The dispersion, which is very well suited for production dot coating, has a viscosity of 35000 centipoises.

EXAMPLE 3

In the same manner as in Example 1, the following constituents are mixed together: 34 kg of GRIL-tex 1 P 1, 2 kg of stearyl alcohol, 9 kg of LATECOLL AS, 6 kg of plasticizer 13 and 49 kg of water. The viscosity of the printable paste is 32000 centipoises. Use as textile adhesives is carried out, for example, in a manner similar to that described in "Textilveredlung" 9 (1974) 1, pp. 23–24.

What is claimed is:

1. In a copolyamide dispersion comprising copolyamide powder with a grain size of up to 0.1 mm., water and a thixotropy-producing agent, the improvement which comprises the presence of 0.2 to 5.0 percent by weight of at least one fatty alcohol based on the total weight of said dispersion.

2. A dispersion according to claim 1 wherein said fatty alcohol is taken from the class consisting of stearyl alcohol, cetyl alcohol and mixtures thereof.

3. A dispersion according to claim 1 where said alcohol is present in an amount of 1 to 3% by weight.

4. A dispersion according to claim 1 wherein a dispersing agent, plasticizer, or a mixture thereof is present.

5. A method for the preparation of a copolyamide dispersion consisting essentially of mixing a copolyamide powder having a grain size of up to 0.1 mm., water and a thixotropy-producing agent with 0.2 to 5.0% by weight of at least one fatty alcohol based on the total weight of said dispersion.

6. A method according to claim 5 including placing said constituents in a vessel, stirring said constituents whereby said constituents are blended to form said dispersion without preparation of any intermediate suspending medium.

7. A method according to claim 5 wherein said dispersion contains 1 to 3% by weight of said alcohol.

8. A method according to claim 5 wherein said alcohol is taken from the class consisting of stearyl alcohol, cetyl alcohol and mixtures thereof.

9. A dispersion according to claim 1 wherein said copolyamide powder consists essentially of ternary or quaternary copolyamides prepared from monomers capable of producing polymers having melting points of 80 to 135° C.

10. A dispersion according to claim 9 wherein said melting points are 100 to 130° centigrade.

11. A dispersion according to claim 1 wherein said copolyamide powder consists essentially of ternary or quaternary copolyamides prepared from monomer constituents of polyamide 6; polyamide 12; polyamide 6,6; polyamide 6,10; polyamide 6,9; or polyamide 6,12.

* * * * *